US005586896A

United States Patent [19]

Casey et al.

[11] Patent Number: 5,586,896

[45] Date of Patent: Dec. 24, 1996

[54] HEATER RING CONNECTOR ASSEMBLY

[75] Inventors: Daniel T. Casey, Harrisburg; Brent D. Yohn, Newport, both of Pa.

[73] Assignee: The Whitaker Corporation, Wilmington, Del.

[21] Appl. No.: 371,243

[22] Filed: Jan. 11, 1995

[51] Int. Cl.[6] ..... H01R 23/68

[52] U.S. Cl. ..... 439/218; 439/439; 439/692

[58] Field of Search ..... 439/682, 218, 439/692, 697, 733, 746, 856

[56] References Cited

U.S. PATENT DOCUMENTS

| | | | |
|---|---|---|---|
| 2,822,529 | 2/1958 | Heath | 439/682 |
| 3,999,105 | 12/1976 | Archey et al. | 317/100 |
| 4,220,393 | 9/1980 | Ammon et al. | 439/682 |
| 4,391,482 | 7/1983 | Czeschka | 439/733.1 |
| 5,064,391 | 11/1991 | Buchter | 439/733.1 |
| 5,152,700 | 10/1992 | Bogursky et al. | 439/733.1 |
| 5,160,281 | 11/1992 | Culver | 439/733.1 |
| 5,334,053 | 8/1994 | Noschese | 439/682 |
| 5,362,256 | 11/1994 | Hashiguchi | 439/733.1 |
| 5,499,164 | 3/1996 | Hill-Lindsay et al. | 361/785 |

OTHER PUBLICATIONS

U.S. Patent Application Ser. No. 08/210,825 (Abstract and Drawings only included).

*Primary Examiner*—Paul T. Sewell
*Assistant Examiner*—Luan Z. Bui
*Attorney, Agent, or Firm*—Anton P. Ness

[57] ABSTRACT

A connector assembly for a heating unit (10) on an aircraft sensor or indicator (or other product application) includes a plug ring (16) having an annular periphery (72) provided with a plurality of circumferentially-spaced plug contacts (40), and a receptacle ring (17) having an annular periphery (42) provided with a corresponding plurality of circumferentially-spaced receptacle contacts (27) receiving the plug contacts (40) on the plug ring (16). The receptacle ring (17) has a pair of adjacent segments each having a plurality of circumferentially-spaced receptacle contacts (27), such that the plug contacts (40) on the plug ring (16) may be received in either plurality of receptacle contacts (27) on the receptacle ring (17).

14 Claims, 11 Drawing Sheets

HEATER RING CONNECTOR ASSEMBLY

FIELD OF THE INVENTION

The present invention relates to electrical connectors and more particularly to ring type connectors.

BACKGROUND OF THE INVENTION

In a variety of product applications, some connectors are required to be disposed circumferentially. Therefore, electrical connectors are known in the art, which are mounted on a circular carrier and provide electrical connection with certain elements of electronic circuitry mounted on another carrier.

For example, U.S. Pat. No. 3,999,105 discloses an integrated circuit package of circular cross-section incorporating a stack of semiconductor wafers mounted on respective insulated carriers. To provide electrical contacts with respective silicon chips, each carrier has a plurality of pins mating with a corresponding plurality of pins on a base plate. These pins protrude through respective through holes drilled in each carrier, and the male end of the pin is mated with the female end of the respective pin secured to the succeeding carrier.

U.S. patent application, Ser. No. 08/210,825 filed on Mar. 18, 1994, and assigned to the Assignee of the present invention, discloses circumferentially-spaced electrical connectors for the assembly of a stacked array of two or more parallel circuit boards, wherein all of the electrical interconnections and mechanical connections are provided between the respective circuit boards.

In this pending '825 application, a plurality of first connectors is mounted to top surfaces of all circuit boards (except for the topmost board) at connector sites that, upon appropriate arrangement of the circuit boards into their positions within the assembly, will be vertically aligned or stacked. The first connectors preferably are disposed at the outer edges or periphery of each board, thus surrounding an interior area of the board's top surface containing a plurality of selected electrical and electronic components mounted thereto. For economy of real estate on the circuit boards, the connectors are arcuately shaped to complement the circular shape of the boards' peripheries. A plurality of second connectors is mounted to the top surface of the topmost board about its periphery aligned with associated stacks of first connectors of the other boards upon final assembly, and each second connector preferably defines an imperforate board-remote surface rather than a mating face.

Further, in this pending '825 application all first connectors possess a common length and width dimensions and extend a common selected height from the board-proximate faces thereof to an opposed mating face, with the arrays of contacts being disposed in vertical passageways thereof. The contacts of each array extend from socket contact sections exposed along the connector mating face to post sections depending below the board-proximate faces to extend through respective through-holes of the associated board for mating with the socket contact sections of the connector therebeneath.

Moreover, certain applications of connectors sometimes require that respective electrical and mechanical connections between a plurality of mating plugs and sockets be provided even if the plugs and sockets change their interposition. For instance, if a connector assembly is intended to be used as an interconnect between a main housing and heating coils, which are located inside a sensor or indicator housing of an aircraft, the same connectors have to be mated even when the main housing is rotated a certain angle and positioned on an opposite side of the aircraft.

In these product applications, it would be desirable to provide a two-ring connector assembly, wherein a plug ring includes a set of contact blades, and wherein a receptacle ring includes two sets of receptacle slots, such that the set of contact blades may be received in either one of the sets of receptacle slots, thereby providing the required flexibility in the contacts mating.

SUMMARY OF THE INVENTION

It is, therefore, an object of the present invention to provide a connector assembly allowing use of the same connector parts on both sides of an aircraft (or other product application).

It is another object of the present invention to provide a connector assembly including two connector rings constituting a plug ring and a receptacle ring, such that the plug ring may be connected to the receptacle ring in two interpositions.

It is still another object of the present invention to provide a connector assembly allowing easy assembly and disassembly, while providing a reliable mechanical and electrical contact.

It is further object of the present invention to provide plug contacts and receptacle contacts which are designed with connection and securing features.

According to the present invention, a connector assembly comprises a pair of rings including a plug ring and a receptacle ring. The plug ring has an annular periphery provided with a plurality of circumferentially-spaced plug contacts. The receptacle ring has a pair of adjacent segments. One of the segments has a plurality of circumferentially-spaced receptacle contacts. The other of the segments has a second plurality of circumferentially-spaced receptacle contacts. The plug contacts on the plug ring may be received in either plurality of receptacle contacts on the receptacle ring.

With this arrangement, one of the pluralities of receptacle contacts is redundant in the actual product application.

In the preferred embodiment, a first housing receives the plug ring, and a second housing receives the receptacle ring. The second housing has an annular groove for receiving the receptacle ring.

Preferably, the plug ring has a plurality of circumferentially-spaced substantially identical plug slits, and a corresponding plurality of plug contacts are received in the respective slits.

The plug contact includes a main portion and a blade integrally connected to the main portion. The blade is projected outwardly from the plug ring to be received within the respective receptacle contact of the receptacle. The plug contact includes a tab on the main body, and the tab is punched out substantially in the center of the main body and is bent to form an acute angle between the tab and the main body.

Each receptacle contact includes a contact portion and a wire portion. The contact portion includes a body having spaced-apart first and second side surfaces, respectively. These first and second side surfaces have a first and a second end, respectively. The wire portion of the receptacle contact is integrally connected to the first side surface of the body at the first end. A first plurality (and alternatively, a second plurality) of substantially parallel spaced-apart contact fingers are integrally connected to the side surface of the body at the second end. These contact fingers resiliently engage the respective plug contacts of the plug ring.

The first and second plurality of contact fingers may include substantially identical contact fingers. These identical contact fingers are bent towards each other to form a narrow space between them to resiliently engage the plug connector and to hold the plug connector between respective contact fingers.

The contact fingers of the first plurality may differ from the contact fingers of the second plurality.

The receptacle ring has a first and a second plurality of substantially identical circumferentially-spaced second slits. Each receptacle contact is secured within a respective one of said first and second pluralities of the second slits.

The body of the receptacle contact includes a tab. The tab is punched out in the first side surface of the body and is bent outwardly to form an acute angle between the tab and the body. This tab resiliently engages in a first plane in the respective second slit on the second ring, thereby flattening the second side surface of the body to the second plane in the second slit.

These and other objects of the present invention will become apparent from a reading of the following specification taken in conjunction with the enclosed drawings.

DETAILED DESCRIPTION OF THE INVENTION

Figure 1:
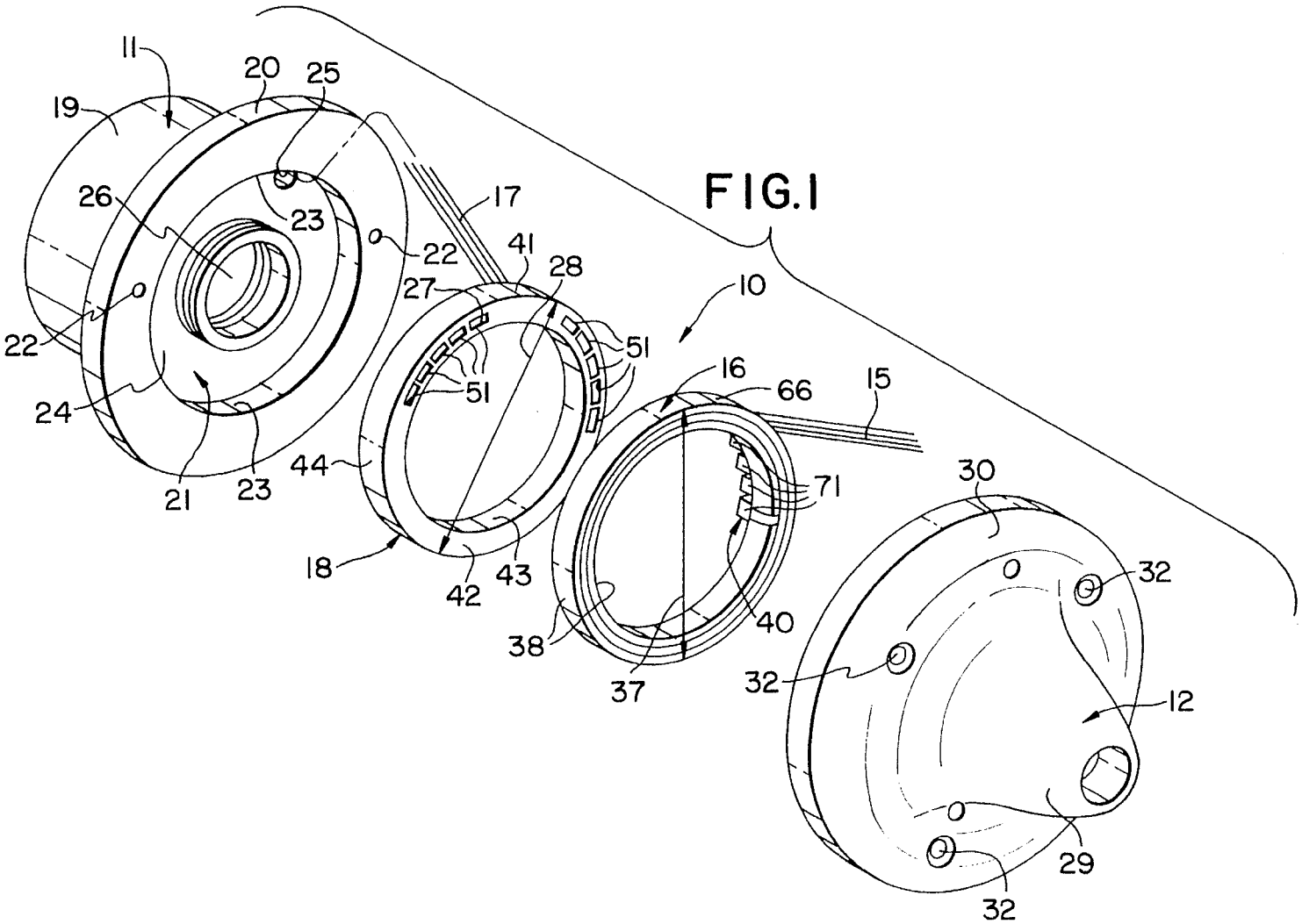
FIG. 1 is an exploded perspective view of a heater connector assembly of the present invention.
Figure 2:
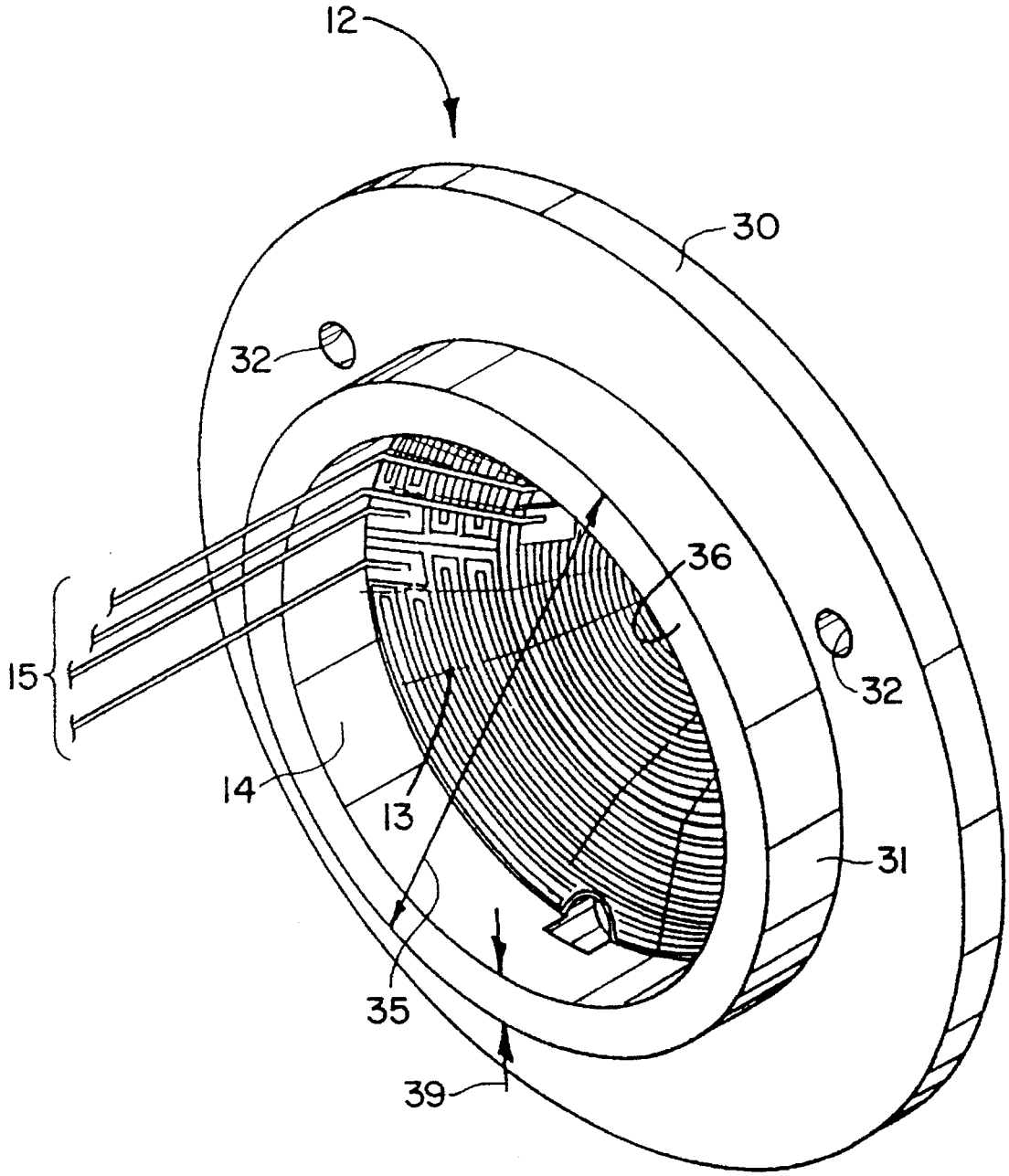
FIG. 2 is a perspective view of the heater housing of the heater of FIG. 1.
Figure 3:
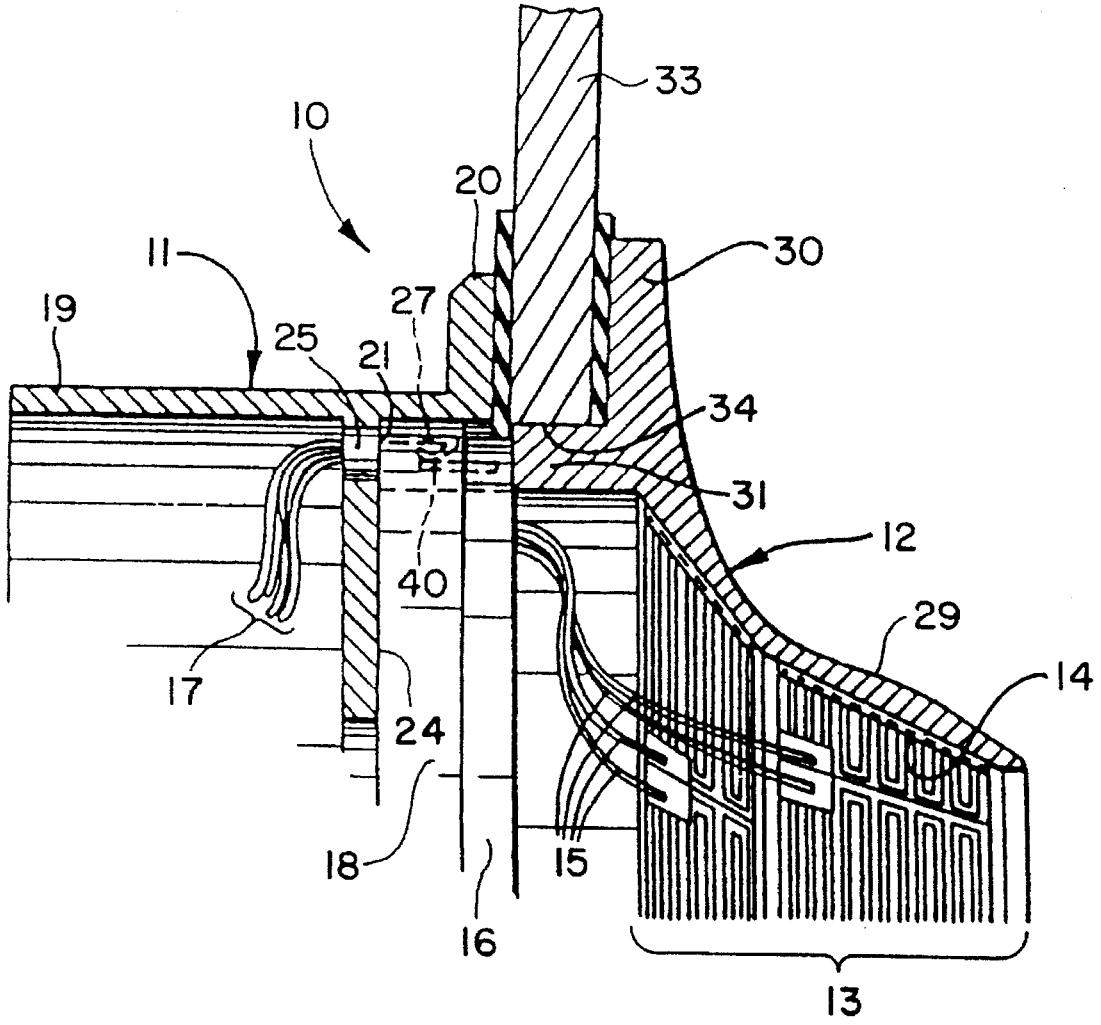
FIG. 3 is a cross-sectional enlarged view of a portion of the heating unit installed in the aircraft.
Figure 5:
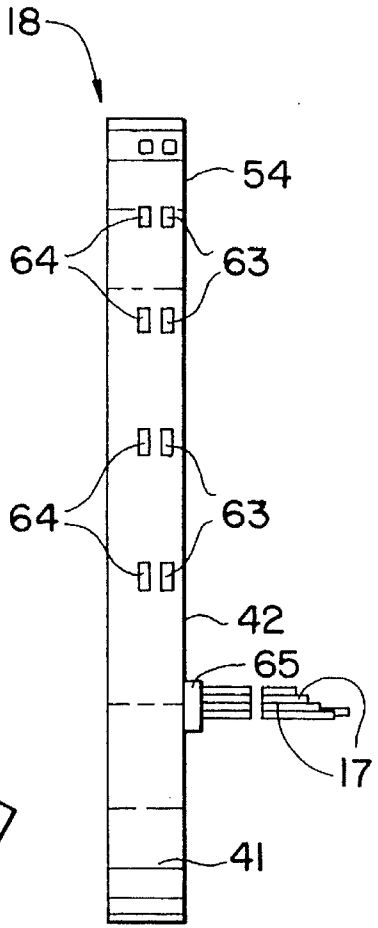
FIG. 5 is a side view of the receptacle ring with receptacle contacts installed.
Figure 4:
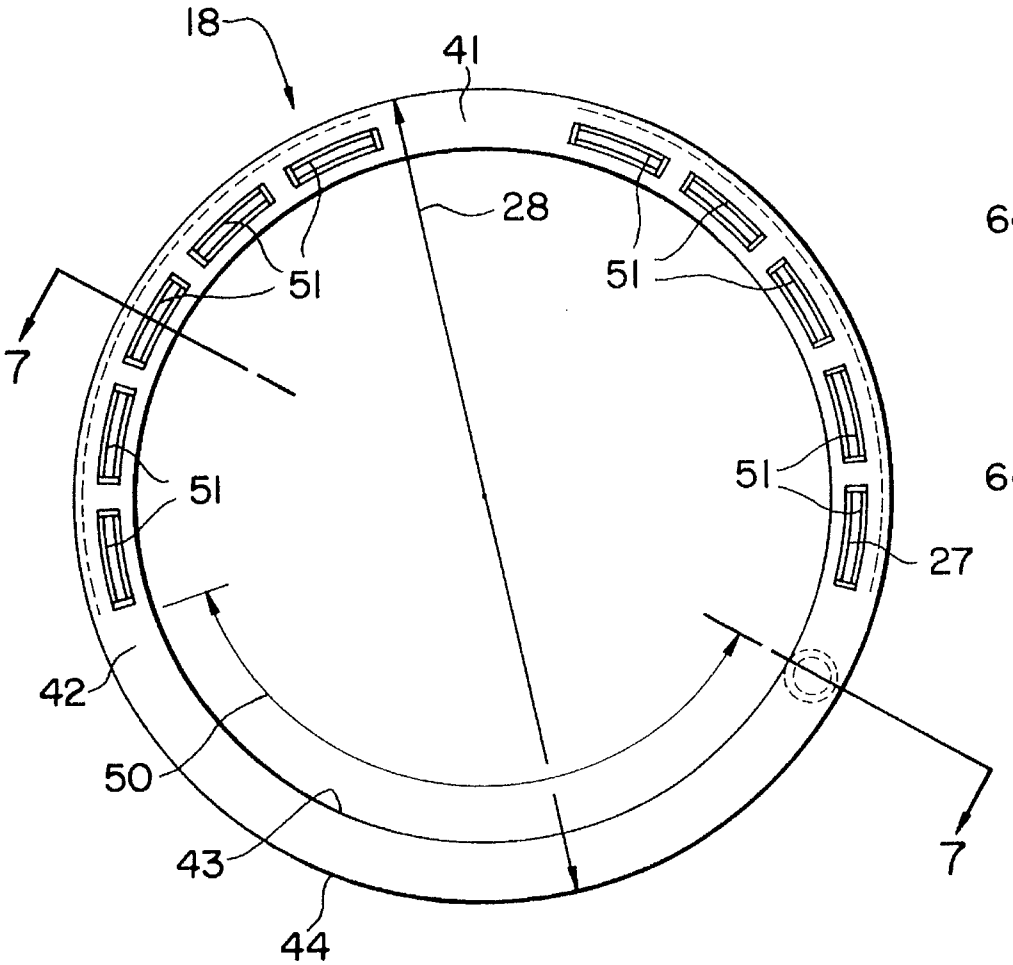
FIG. 4 is a front view of the receptacle ring of the present invention.
Figure 7:
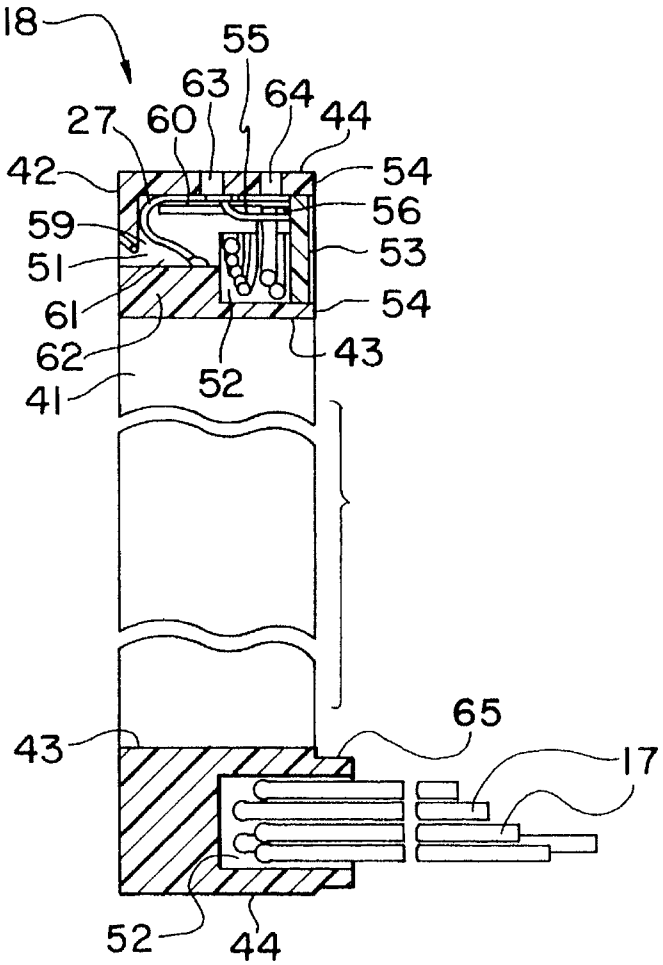
FIG. 7 is a cross-sectional view of the receptacle ring of FIG. 4 taken along lines 7—7 thereof.

Referring to FIGS. 1–3, a heating unit 10 includes a main housing 11 and a heater housing 12. Heating coils 13 are located inside the heater housing 12. The heater housing 12 serves as a sensor or indicator housing of an aircraft (not shown) such as may be used to sense angle of attack, and it may be required to be positioned on both sides of the aircraft. However, it will be appreciated that the present invention is not confined thereto but, rather, is equally applicable to a variety of product applications.

With this in mind, the heating coils 13 are glued to an internal surface 14 of the heater housing 12, as best shown in FIG. 2. Electrical current is supplied to the heating coils 13 from a source of power (not shown) outside the heating unit 10 via wires 15 on a plug ring 16 and wires 17 on a receptacle ring 18. The heating unit 10 provides a desired heating to the indicator, thereby reducing the influence of the outside ambient temperature on the indicator performance.

The main housing 11 has a cylindrical body 19, a flange 20, and an annular groove 21. Holes 22 on the flange 20 accommodate screws (not shown) to secure the main housing 11 to the panel 33 of the aircraft. A diameter 23 of the annular groove 21 is made equal to a diameter of an opening 34 in the aircraft where the main housing 11 is to be installed. The bottom 24 of the annular groove 21 has an aperture 25 for wires 17 (as discussed herein). An opening 26 is located substantially in the center of the annular groove 21.

With reference to FIGS. 1–7, the receptacle ring 18 is mounted to the main housing 11 within the annular groove 21. The wires 17, which are connected to receptacle contacts 27 secured to the receptacle ring 18, pass through the aperture 25 to terminate in the source of power. An outer diameter 28 of the receptacle ring 18 is adapted to the diameter 23 of the annular groove 21, such that the receptacle ring 18 can be installed and secured within the annular groove 21.

The heater housing 12 is installed and secured to the outside of the panel 33 of the aircraft (FIG. 3). The heater housing 12 (FIG. 2) has a nosecone body 29, a flange 30, and a cylindrical ring 31 protruded from the flange 30 in a direction opposite to the nosecone body 29. The flange 30 has through holes 32 for receiving screws (not shown) which secure the heater housing 12 to the aircraft. The outer diameter 35 of the cylindrical ring 31 is adapted to fit into the opening 34. The plug ring 16 is mounted to a front surface 36 of the cylindrical ring 31. As best shown in FIG. 3, the diameter 37 and thickness 38 of the plug ring 16 fit to the diameter 35 and thickness 39 of the cylindrical ring 31. The plug ring 16 is secured to the cylindrical ring 31 by any means known by those skilled in the art, as for instance, by an adhesive. The wires 15 connect plug contacts 40 secured within the plug ring 16 to the respective heating coils 13.

Figure 6:
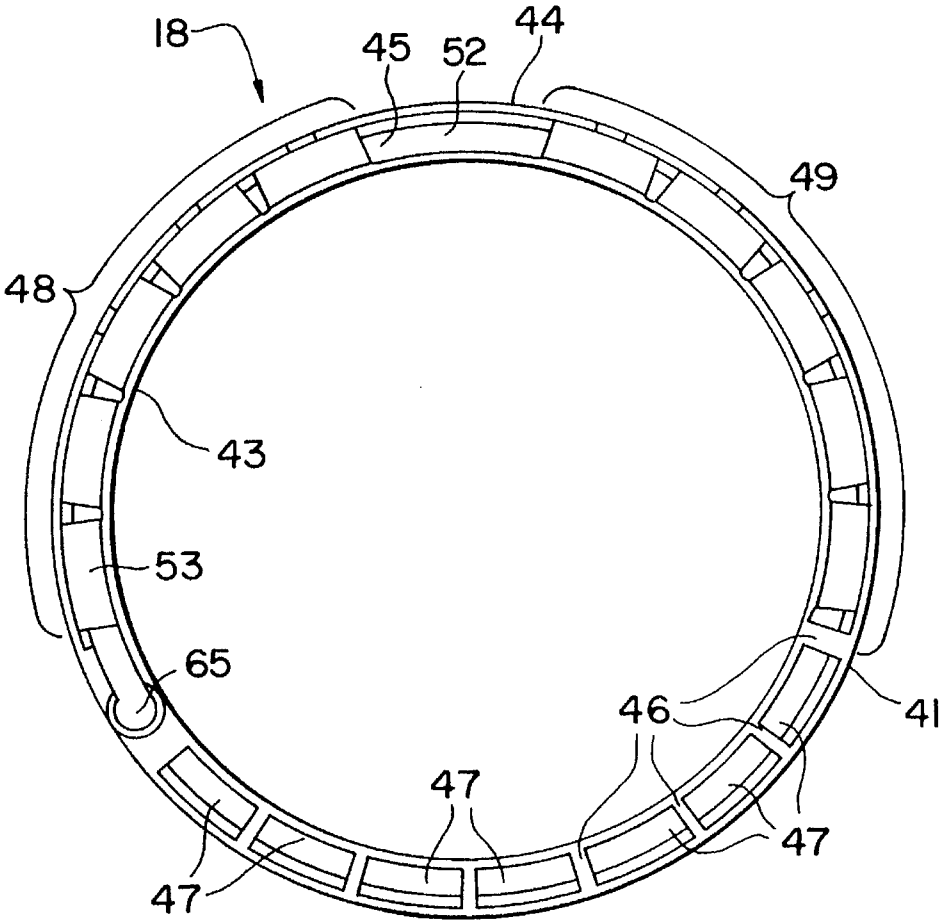
FIG. 6 is a rear view of the receptacle ring.
Figure 8:
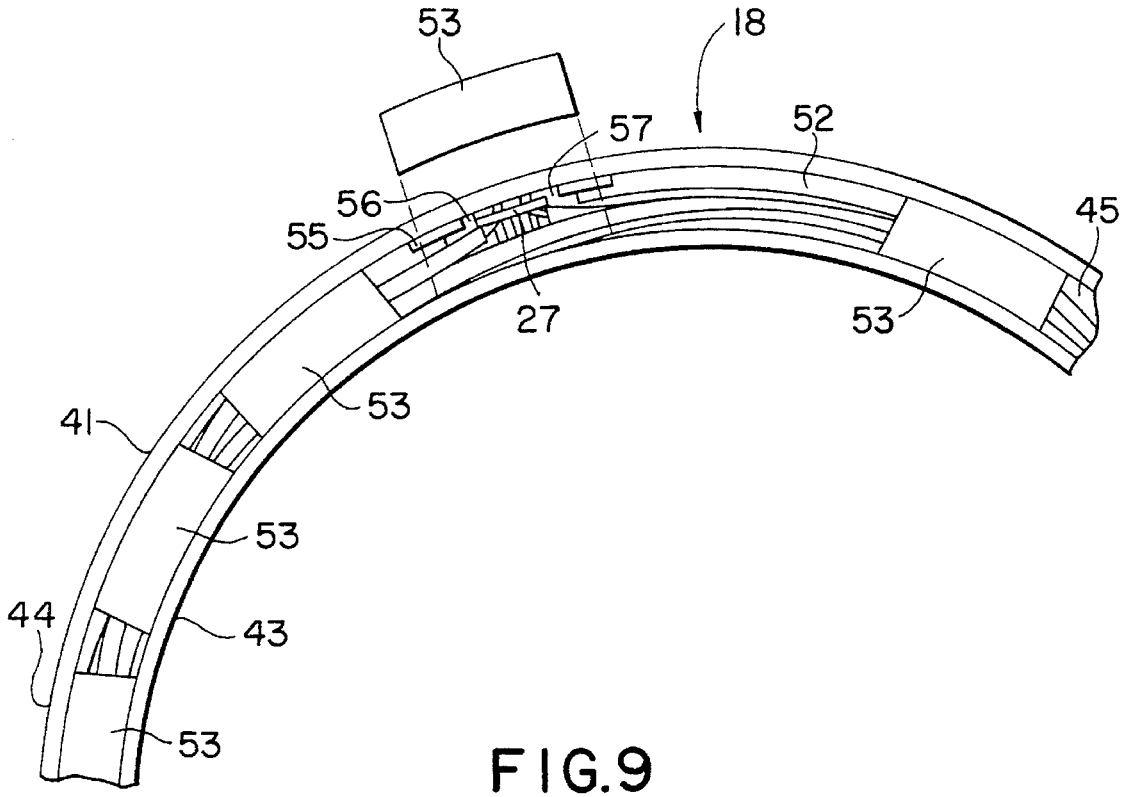
FIG. 8 is a rear view of a portion of the receptacle ring, drawing to an enlarged scale.
Figure 9:
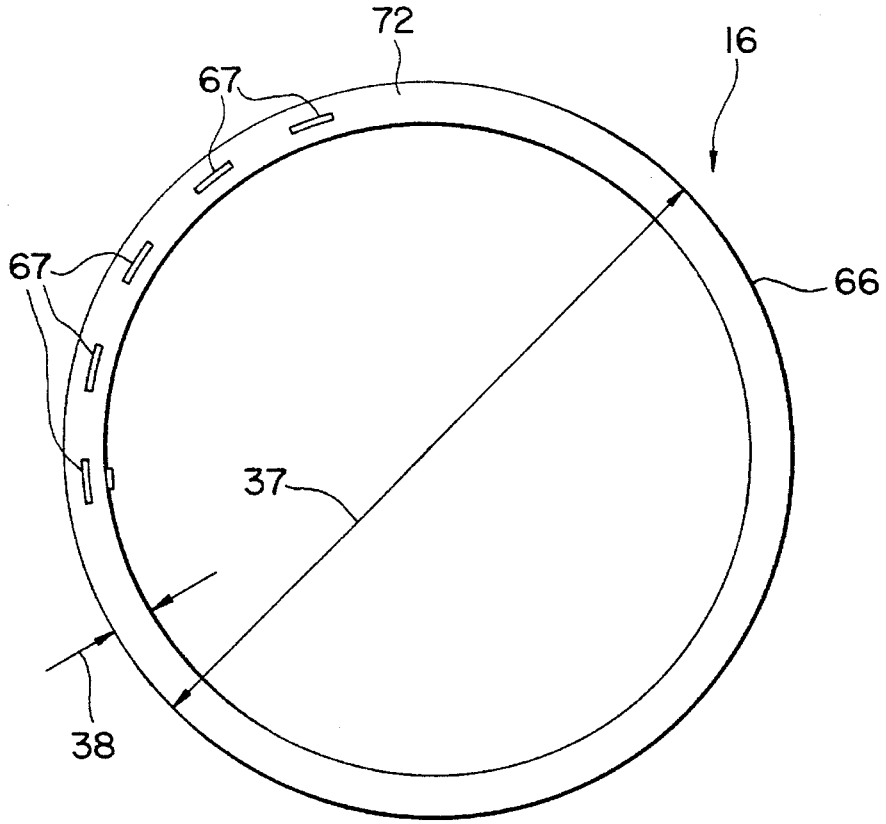
FIGS. 9 and 10 are front and rear views of the plug ring of the present invention.
Figure 10:
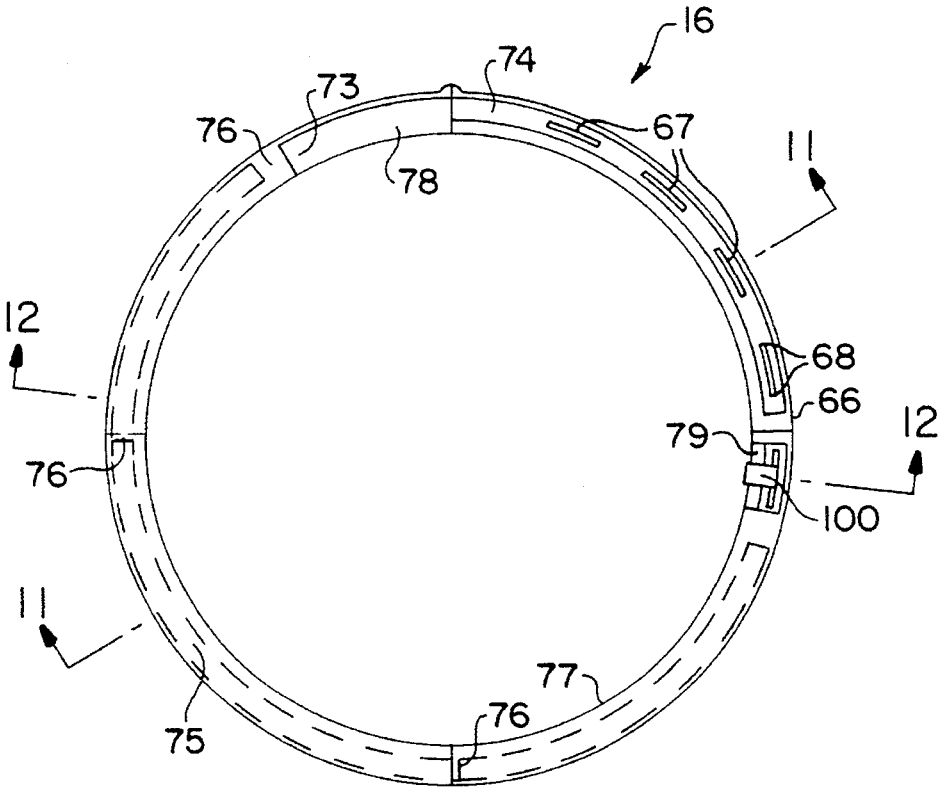
Figure 11:
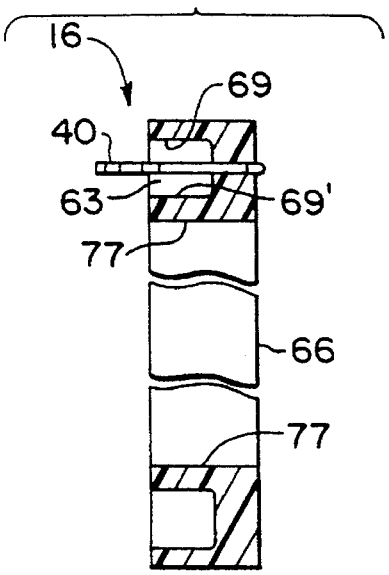
FIG. 11 is a cross-sectional view of the plug ring, taken along lines 11—11 of FIG. 10.

With reference to FIGS. 4–8, the receptacle ring 18 includes a plastic ring body or insulative ring housing 41 having a mating surface (or annular periphery) 42, internal 43 and outer 44 side walls, respectively, and a back trepan 45. A part of the back trepan 45 has a plurality of separating walls 46 which form cavities 47 limited by the walls 46 and outer 44 and internal 43 side walls. The receptacle ring 18 is divided for three substantially equal segments 48, 49 and 50, respectively. Each of segments 48 and 49 includes five circumferentially-spaced receptacle contacts 27. The mating surface 42, corresponding to the segments 48 and 49, includes two sets of substantially identical circumferentially-spaced receptacle slits 51 arrayed tangentially to a common arc of the ring housing 41. Each receptacle contact 27 is installed and secured within the respective receptacle slit 51. The back trepan 45, corresponding to the segments 48 and 49, does not include the separating walls 46 in order to allow a channel-like space 52 for wires 17. As best shown in FIGS. 6 and 8, the wires 17 are covered by a plurality of plates 53 which are secured to edges 54 of the outer 44 and internal 43 side walls of the receptacle ring 18 for sealing and preventing shorting-out. Alternatively, a single arcuate plate (not shown) can be used to insulate simultaneously all receptacle contacts and exposed wire conductors.

The back trepan 45 has ledges 55 separated by receptacle contacts 27. As best shown in FIG. 8, each separating ledge 55 has a T-shaped edge 56 to allow space for side projections 57 of a wire-connecting portion 58 (to be discussed below) of the receptacle contact 27.

Each receptacle slit 51 has a recess 59 with first 60 and second 61 substantially parallel planes. The plane 60 is an internal surface of the outer side wall 44; the plane 61 is separated from the internal side wall 43 by a ledge 62. The plane 60 has through openings 63 and 64 (to be discussed below).

The ring body 41 has a wire outlet 65 to let wires 17 soldered to each receptacle contact 27 out from the receptacle ring 18, and then through the aperture 25 in the bottom 24 of the main housing 11 to the source of power.

Referring to FIGS. 9–12, the plug ring 16 includes a plastic ring body or insulative ring housing 66, with five circumferentially-spaced substantially identical plug slits 67 arrayed tangentially to a common arc of ring housing 66 and five plug contacts 40 secured within the plug slits 67. This set of five plug contacts 40 is to be received in one of two sets of five receptacle contacts 27 on the receptacle ring 18. Each plug slit 67 has a pair of side walls 68 and a pair of internal surfaces 69. A respective bump 70 (FIG. 14) is provided on each side wall 68.

Blades 71 of the plug contacts 40 are projected outwardly from an annular periphery (mating part) 72 of the plug ring 16. Opposite to the annular periphery (mating part) 72, the ring body 66 has a back trepan 73. The back trepan 73 has a space 74 for accommodation of wires 15 soldered to the plug contacts 40, and space 75 separated by separating walls 76. Internal side wall 77 of the plug ring 16 allows two recesses 78 and 79. The recess 78 serves as an outlet for wires 15. The recess 79 allows space for grounding plug contact 40' (to be discussed below).

Figure 19:
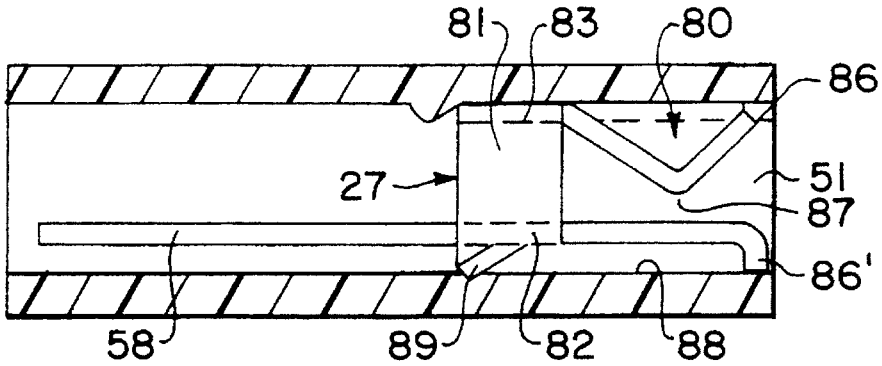
FIG. 19 is a side view of a receptacle contact of FIG. 18.
Figure 20:
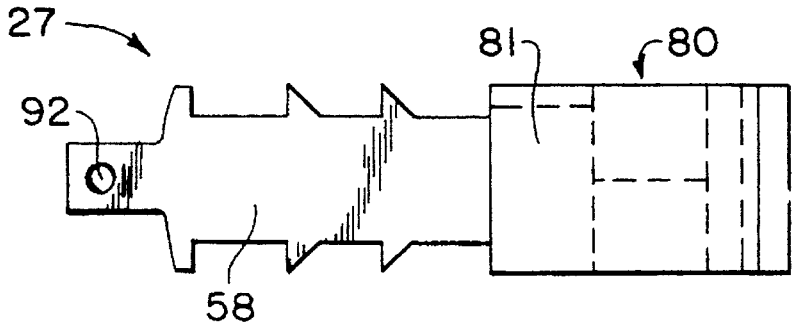
FIG. 20 is a side view of the receptacle contact of yet another modification.
Figure 21:
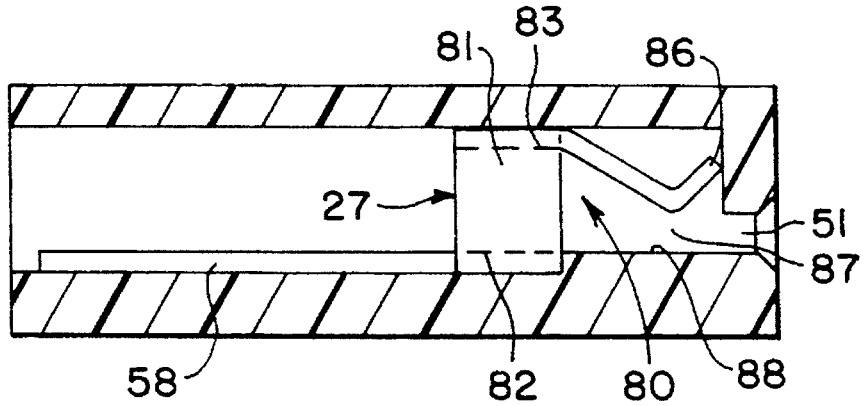
FIG. 21 is another side view of the receptacle contact of FIG. 20.

As shown in FIGS. 16–24, the receptacle contact 27 includes a contact portion 80 and the wire-connecting portion 58. The contact portion 80 includes a body 81. The body 81 has spaced-apart side surfaces 82 and 83, each of which has respective ends 84,84' and 85,85', respectively. The wire-connecting portion 58 is integrally connected to the end 84 of the side surface 82. Substantially parallel spaced-apart contact fingers 86 (FIG. 21) are integrally connected to the end 85' of the side surface 83 to resiliently engage the respective plug contacts 40. In another modification, as best shown in FIGS. 16–20, contact fingers 86' are integrally connected to the end 84' of the side surface 82. The contact fingers 86 and 86' may be made to be substantially identical, as shown for example in FIGS. 16 and 17, and the contact fingers 86 may also differ from the contact fingers 86', as shown in FIGS. 19 and 20. The contact fingers 86 are bent to form a narrow space 87 between the contact fingers 86 and 86', or between contact fingers 86 and the respective plane 88 of the receptacle slit 57 thus defining a blade-receiving portion. The contact fingers 86' and/or 86 resiliently engage the blades 71 of the plug contact 40, when ends blade 71 is received in the narrow space 87, thereby providing an electrical and mechanical contact between the receptacle contacts 27 and plug contacts 40.

As shown in FIG. 19, the surface 82 of the body 81 may include a tab 89 which is punched out and bent outwardly to form an acute angle with the surface 82. Being protruded through the opening 83, the tab 89 engages the plane 88 thereby securing the receptacle contact 27 within the slit 51.

The wire-connecting portion 58 of the receptacle contact 27 is integrally connected to the end 84 of the surface 82 of the body 81. The wire-connecting portion 58 of the receptacle contact 27, shown in FIGS. 16–21, is blade-shaped and has respective protrusions 90 at each side of the wire-connecting portion 58. Being inserted into the ring body 66 within the receptacle slits 57, the protrusions 90 engage respective bumps (not shown) in the,slits 51 to facilitate securing the receptacle contacts 27 within the receptacle slits 57. The manner in which the protrusions 90 engage with would-be bumps within the slits 57 will be understood by those skilled in the art, being very similar to the plug contacts 40 shown in FIGS. 14 and 15.

Figure 22:
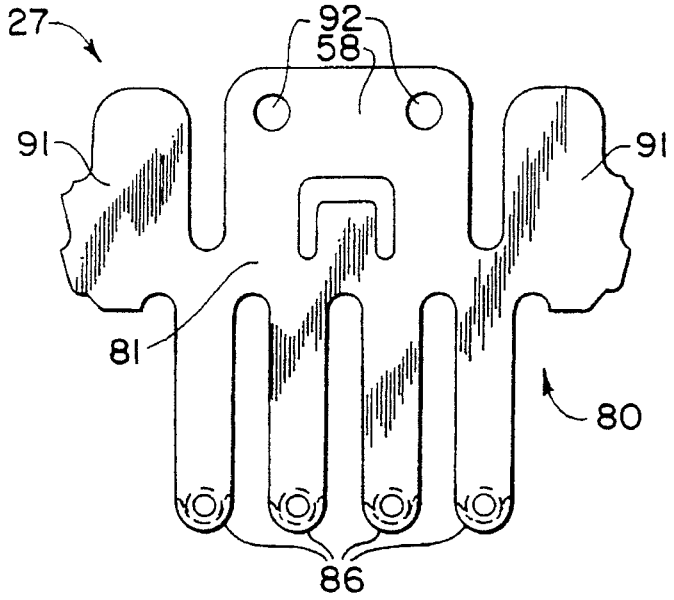
FIG. 22 is a flat blank layout for the receptacle contact of still another modification.
Figure 23:
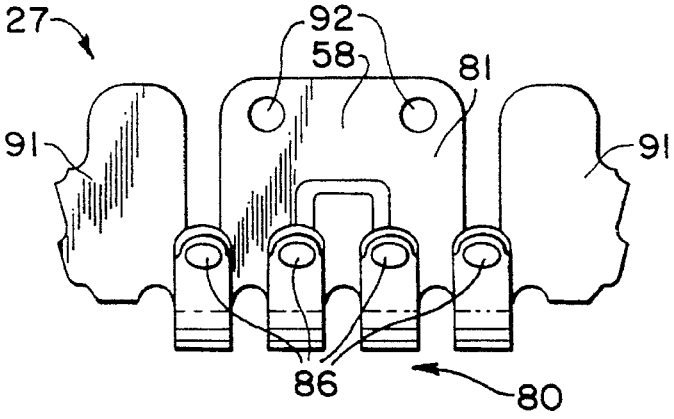
FIGS. 23 and 24 are front and side views of the receptacle contact of FIG. 22.
Figure 24:
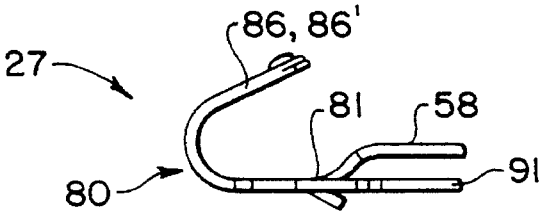

As best shown in FIGS. 22–24, another modification of the receptacle contact 27 is possible. The wire-connecting portion 58 includes two side protrusions 91, which engage separating T-shaped ledges 55 to facilitate securing the receptacle contacts 27 within the receptacle slits 52.

Each wire-connecting portion 58 has one or two holes 92 for soldering the wires 17 to the wire-connecting portion 58.

Figure 13:
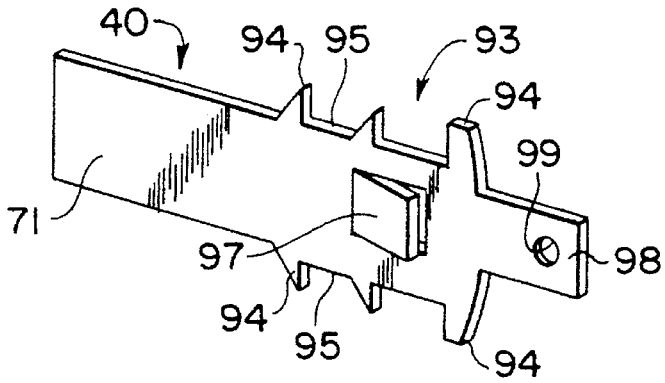
FIG. 13 is a perspective view of the plug contact.
Figure 14:
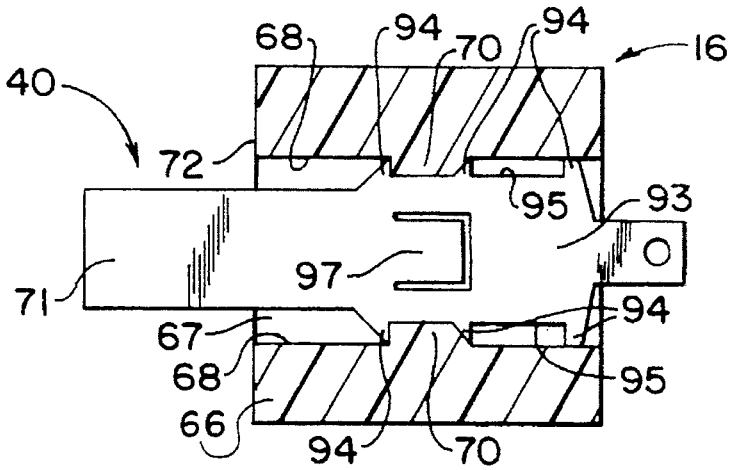
FIG. 14 is a side view of the plug contact of FIG. 13 in the pre-solder position.
Figure 15:
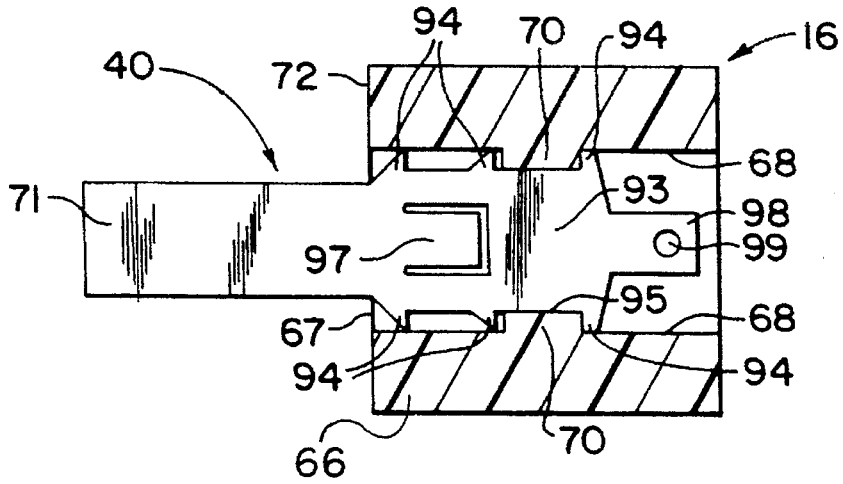
FIG. 15 is a side view of the plug contact of FIG. 13 in the post-solder position.
Figure 16:
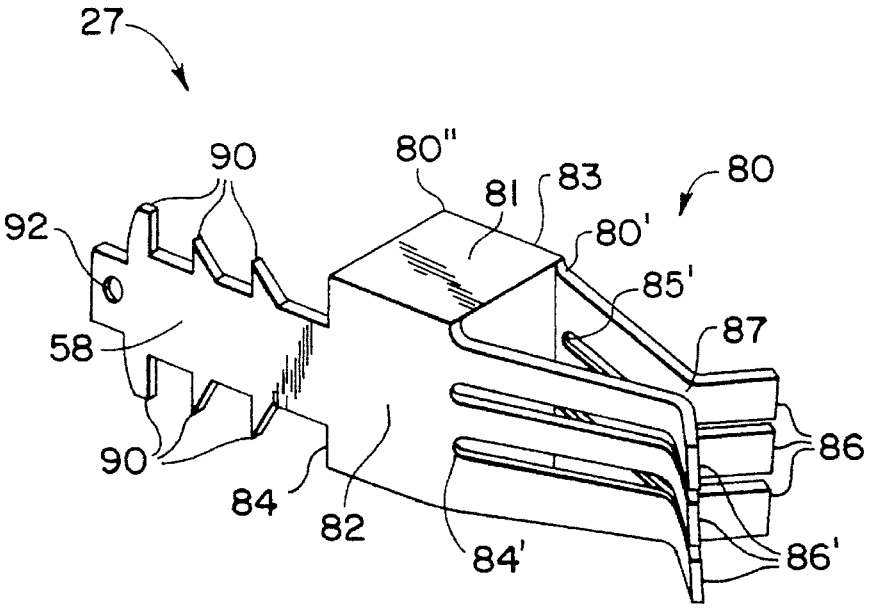
FIG. 16 is a perspective view of the receptacle contact.
Figure 17:
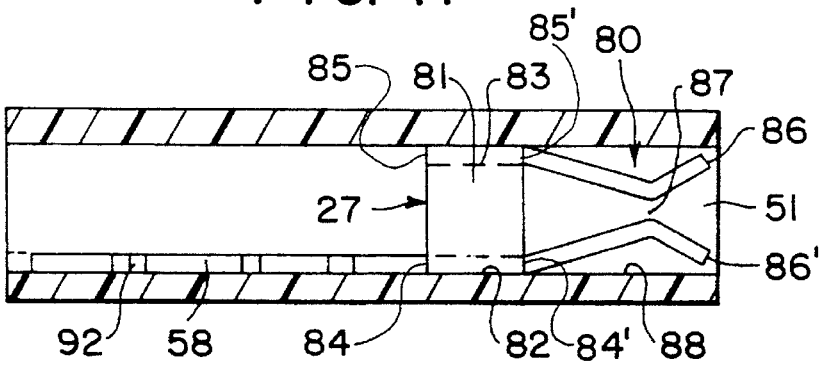
FIG. 17 is a side view of the receptacle contact of FIG. 16 within the receptacle ring.
Figure 18:
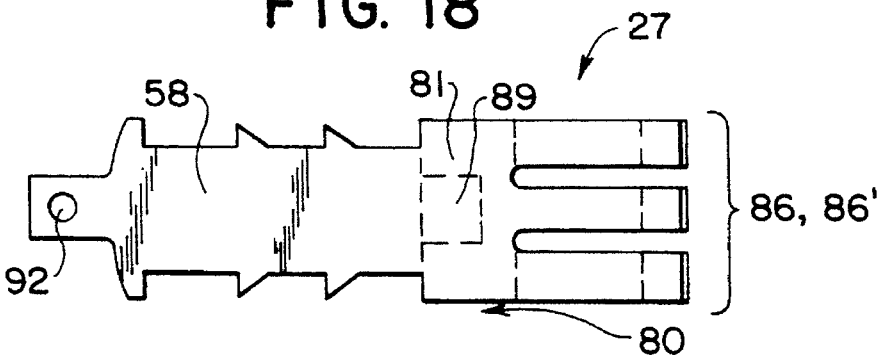
FIG. 18 is a side view of the receptacle contact of another modification.

Referring to FIGS. 13–15, each plug contact 40 includes a main portion 93 and the blade 71 integrally connected to the main portion 93.

Respective projections 94 are provided on each side 95, 96 of the main portion 93 for engaging with respective bumps 70 on the side walls 68 of the respective plug slit 67. A tab 97 is punched out substantially in the outer of the main portion 93 and is bent to form an acute angle between the tab 97 and the main portion 93. The tab 97 resiliently engages the internal surface 69 within the plug slit 67, thereby flattening the main portion 93 of the plug contact 40 to the opposite internal surface 69'.

Figure 12:
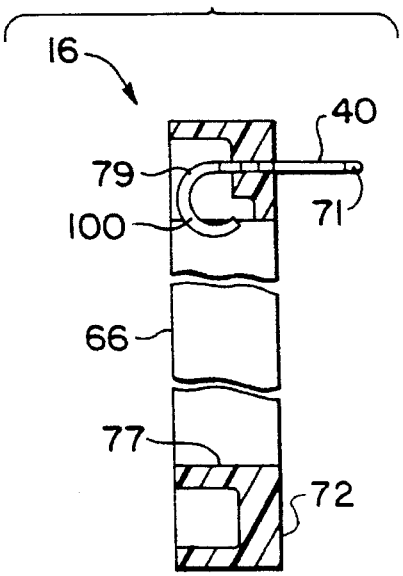
FIG. 12 is a further cross-sectional view of the plug ring, taken along lines 12—12 of FIG. 10.

A wire-connecting portion 98 is integrally connected to the main portion 93 and has a hole 99 to solder the wires 15 therein. The blade 71 is protruded through the respective plug slits 67 and is extended outwardly from the annular periphery 72 of the plug ring 16. In the installation process, the plug contacts 40 are first pre-loaded in the respective plug slit 67 (as best shown in FIG. 14). Then, the wires 15 are attached to the holes 99 on the wire-connecting portion 98. Then the plug contacts 40 are fully inserted into the ring body 66 (as best shown in FIG. 15). Five plug contacts 40 are numbered one through five. The number one plug contact 27 is longer than other four, so as to provide for this contact a "first in—last out" type of mating with the respective receptacle contact. This contact is also designed with an external grounding feature 100 (as best shown in FIG. 12). The grounding feature 100 is protruded through the recess 79 on the internal side wall 77 of the plug ring 16.

On the receptacle ring 18, the receptacle contacts 27 are also pre-loaded and by means of a locking lance (not shown), are positioned so that the wires 17 can be attached. Once the wires 17 are attached, the receptacle contacts are pushed to their final position such that the tab 89 engages the opening 63.

A multi-finger configuration of the receptacle contacts 27 assures good engagement with the plug contacts 40 even in the presence of a misalignment of three degrees (3°).

An optional alignment feature can be incorporated between the main housing 11 and the heater housing 12, if desired. The main housing 11 with the receptacle ring secured thereto may be required to be installed in both sides of the aircraft. If installed on the opposite side of the aircraft, the main housing must be rotated 120° in order to keep the same direction of the wires within the aircraft. This 120° rotation of the main housing changes interposition between the plug contacts and the receptacle contacts, and therefore different contacting assemblies would be needed to be installed on opposite sides of the aircraft. Availability of two sets of receptacle slits 51 allows for the same main housing to be used on either side of the aircraft (or other product applications).

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A connector assembly comprising a pair of rings including a first ring defined by a first insulative ring housing and having an annular periphery provided with a plurality of circumferentially-spaced plug contacts, and a second ring defined by a second insulative ring housing and having an annular periphery provided with a like plurality of circumferentially-spaced receptacle contacts receiving the plug contacts on the first ring;

said second ring having a pair of adjacent segments, one of the segments having said like plurality of circumferentially-spaced receptacle contacts, and the other of the segments having a second plurality of circumferentially-spaced receptacle contacts equal in number to said like plurality, said receptacle contacts in one segment being equal in number to all of the plug contacts on said first ring, such that the plug contacts on the first ring may be received in either plurality of receptacle contacts on the second ring upon mating.

2. The connector assembly of claim 1, wherein each receptacle contact includes a contact portion and a wire portion, the contact portion including a body, said body having spaced apart first and second side surfaces, respectively, said first and second side surfaces having a first and a second end, respectively, the wire portion of the receptacle contact being integrally connected to the first side surface of the body at the first end, a first plurality of substantially parallel spaced apart contact fingers being integrally connected to the second side surface of the body at the second end, said contact fingers for resiliently engaging the respective plug contacts of the first ring.

3. The connector assembly of claim 2, wherein said receptacle contact further has a second plurality of substantially parallel spaced-apart contact fingers integrally connected to the first side surface of the body at the second end.

4. The connector assembly of claim 3, wherein said first and second plurality of contact fingers includes substantially identical contact fingers, said contact fingers being bent towards each other to form a narrow space between them to resiliently engage the plug connector and to hold the plug connector between each of said contact fingers of the first plurality and the respective each of said contact fingers of the second plurality.

5. The connector assembly of claim 3, wherein said contact fingers of the first plurality differ from said contact fingers of the second plurality.

6. The connector assembly of claim 2 wherein each said receptacle contact includes three projections along each side thereof spaced to receive between adjacent ones thereof a bump along adjacent surfaces of a said second slit, such that said receptacle contact is inserted along said slit to a first position permitting wire connection to said wire portion at said first end thereof, and thereafter to a fully inserted position wherein said wire portion is disposed within said insulative ring housing of said second ring and said contact portion is positioned to receive a corresponding said blade thereinto upon connector mating.

7. The connector assembly of claim 1 wherein at least said second ring defines an annular channel into a surface opposed to said mating surface for routing a plurality of wires therewithin, each said wire extending from a wire exit to at least one respective said receptacle contact, and at least one cover member is secured to said insulative ring housing to retain said wires in said annular channel and to insulate at least one said receptacle contact.

8. The connector assembly of claim 1 wherein at least said first ring defines an annular channel into a surface opposed to said mating surface thereof for routing a plurality of wires therewithin, each said wire being connected to a respective said plug contact.

9. The connector assembly of the claim 8, wherein each of said second slits has a first and a second spaced apart substantially parallel planes.

10. The connector assembly of claim 9, wherein the body of the receptacle contact includes a tab, the tab being punched out in the first side surface of the body and bent outwardly to form an acute angle between the tab and the body, and said tab engaging the first plane in the respective second slit on the second ring.

11. The connector assembly of claim 1 wherein said first ring has a plurality of circumferentially-spaced substantially identical first slits arrayed tangential to a common arc about a mating surface of said first ring with blades of respective said plug contacts extending therethrough outwardly from said mating surface, and said second ring has a first and a second plurality of substantially identical circumferentially-spaced second slits arrayed tangential to a common arc about a mating surface of said second ring, each said receptacle contact being secured within said second ring with a blade-receiving portion aligned with a respective second slit of one of said first and second pluralities thereof for mating with a said blade.

12. The connector assembly of claim 11, wherein each of said plurality of first slits has a pair of side walls and first and second internal surfaces, respectively, and each of said side walls of each said first slit has a respective bump, wherein the plug contact includes a main portion and said blade is integrally connected to the main portion, and the main portion has a pair of sides, with respective projections being provided on each said side of the main portion, and wherein the main portion is secured within the respective first slit, and the respective projections engage the respective bump on each said side wall of the first slit.

13. The connector assembly of claim 12, wherein said plug contact includes a tab on the main portion, the tab being punched out substantially in the center of the main portion and bent to form an acute angle between the tab and the main portion, said tab resiliently engaging the first internal surface of the first slit, thereby flattening the main portion of the plug contact to the second internal surface of the first slit.

14. The connector assembly of claim 12 wherein each said plug contact includes three said projections along each said side of said main portions spaced to receive said bump between adjacent ones thereof, such that said plug contact is inserted along said slit to a first position permitting wire connection to a wire connecting end thereof opposed to said blade, and thereafter to a fully inserted position wherein said wire connecting end is disposed within said insulative ring housing of said first ring and said blade is fully extended beyond said mating surface to be received into a corresponding said receptacle contact of said second ring upon connector mating.

* * * * *